United States Patent [19]

Yuhara

[11] 4,280,632

[45] Jul. 28, 1981

[54] BOTTLE CAP

[76] Inventor: Yukitomo Yuhara, 5-29-10, Tachibana, Sumida-ku, Tokyo, Japan

[21] Appl. No.: 100,123

[22] Filed: Dec. 4, 1979

[30] Foreign Application Priority Data

Sep. 17, 1979 [JP] Japan ..... 54-126877[U]

[51] Int. Cl.[3] ..... B65D 41/04

[52] U.S. Cl. ..... 215/331; 215/334; 215/342

[58] Field of Search ..... 215/331, 334, 342

[56] References Cited

U.S. PATENT DOCUMENTS

| | | | |
|---|---|---|---|
| 2,689,665 | 9/1954 | Martin | 215/334 |
| 3,219,222 | 11/1965 | Davidson | 215/334 |
| 3,315,830 | 4/1967 | Flynn | 215/334 |
| 4,093,096 | 6/1978 | Augros | 215/334 X |

*Primary Examiner*—Donald F. Norton

*Attorney, Agent, or Firm*—Fleit & Jacobson

[57] ABSTRACT

A cap for closing a bottle shaped container. The cap has an inner lid formed with a ring groove that receives a lateral rib protruding inwardly from an outer lid that encompasses the inner lid. The inner lid has a sealing plate forming the top thereof that has a central portion connected to a side peripheral portion by a flexible hinged structure so that the central portion is movable with respect to the peripheral portion. Cushion material is formed integrally with or attached to the central portion of the inner lid and is contacted by the outer lid to urge the central portion into contact with the container thereby providing an air-tight seal.

4 Claims, 5 Drawing Figures

10
7
8
13
8
7
4
2
5
11
1
6
12
3

10
8
9
7
4
2
5
11
1
2
6
3-12

10
8
9
8
7
4
2
11
1
5
2
6
12
3

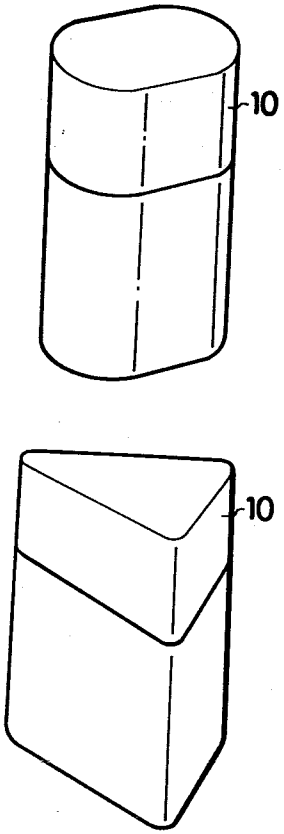
FIG.5
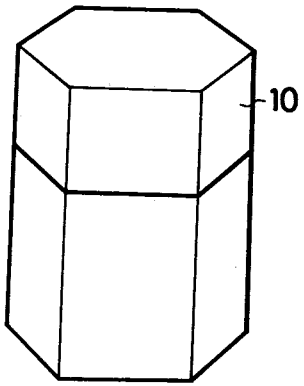
FIG.3
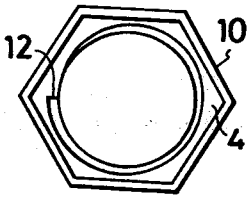
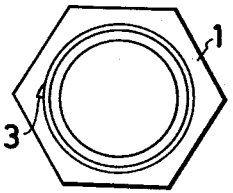

BOTTLE CAP

FIELD OF THE INVENTION

This invention relates to a bottle shaped container having lid or a stopper at a capsule portion, that provides air-tightness. The position of the angle between said container and its lid is adjustable to prevent the stopper restitution. More particularly, invention relates to a container having an adjusting mechanism of the position of a capsule of the container and an inner lid screwing a double cap with the capsule of the container, said double cap being composed of an outer lid possibly covering the inner lid integrally and the inner lid having a flexible hinged structure which freely expands or contracts around the outer circumference of a sealing plate attaching a cushion material on the plate.

BACKGROUND OF THE INVENTION

In a conventional bottle shaped container, it is difficult to keep the capsule portion completely air-tight, and in a non-cylindrical container, such as a container shaped as an ellipse, triangle, square or the like it is also difficult to adjust the position of the non-cylindrical container with the lid having the same shape as that of the container, irrespective of the necessity of screwing said lid with said container after adjustment of the position. Further, such container has such a defect as being impossible to seal the capsule portion with the lid because the stopper of the lid moves away from the container and slackens by dint of the inner pressure in container, the vibration in transportation or the like.

This invention relates to a quite novel technique which amends the conventional defects.

BRIEF DESCRIPTION OF THE INVENTION

FIG. 3 is a plan view of an inner bottom of the outer lid and of the container, respectively.

FIG. 5 is a perspective view which shows the external shapes of various containers and outer lids.

DETAILED DESCRIPTION OF THE DRAWING

Figure 4:
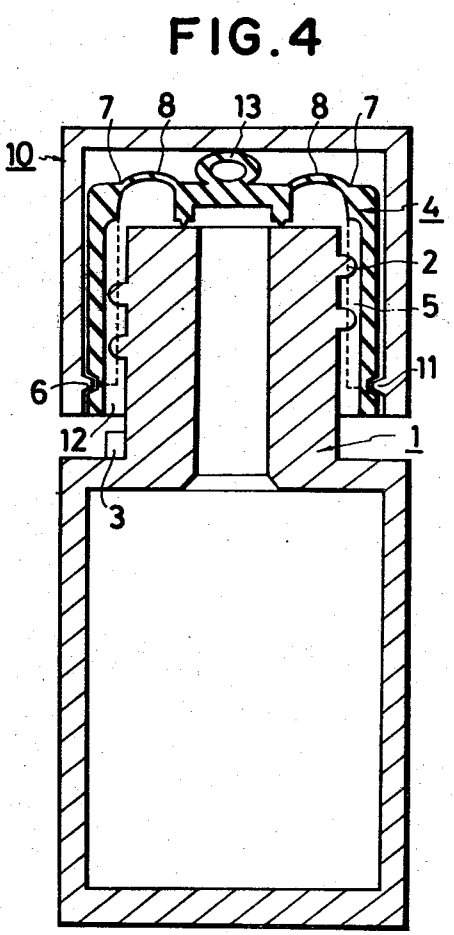
FIG. 4 is a sectional view of another embodiment.
Figure 2:
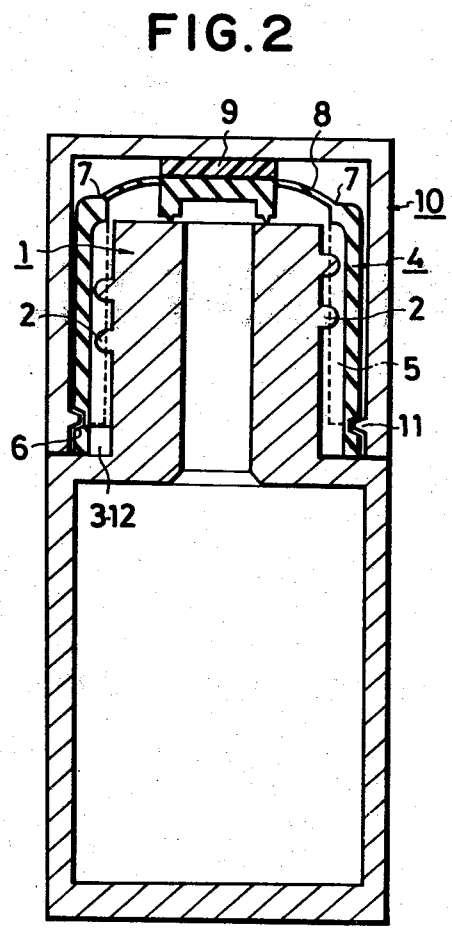
FIG. 2 is a cross sectional view showing a condition wherein the capsule portion of the container is completely closed by inserting the lids of FIG. 1 into the container.
Figure 1:
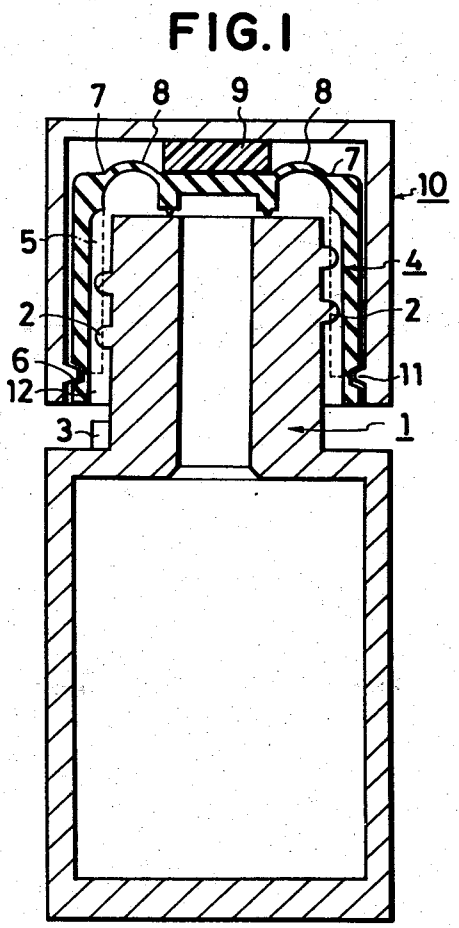
FIG. 1 is a cross sectional view illustrating the container with the inner and outer lids.

Referring to the embodiment of an example of this invention in FIGS. 1 to 3, the numeral 1 identifies a bottle capsule having screws 2 and a protuberance 3 protruded from the outer circumference wall and the shoulder portion of the container, respectively for adjusting the position of a stopper. The numeral 4 is an inner lid being able to screw with the capsule 1, having a bored screw groove 5 at the inner wall face, and a bored ring groove 6 at the lower part of the circumference wall. Further, the sealing plate 7 of the container is structured to form a hinged construction 8 flexible around its circumference that is thinner in thickness so that this portion is able to expand or contract to some extent by the up and down movement of the outer circumference wall.

The numeral 9 is a cushion material made of an elastic foam resin or the like pasted on the face of the sealing plate 7. Further, the numeral 10 is an outer lid which is able to insert integrally to said inner lid 4 to cover thereon, and at the lower part of the outer wall there exists a protruded lateral rib 11 which is insertable into a ring groove 6 of the inner lid 4. Further, at the lower part of the inner wall surface of said inner lid 4 a partial cutaway part 12 is bored which can catch the protuberance 3 of the capsule 1.

Although in said example the cushion material is pasted on the surface of the sealing plate 7 of the inner lid 4, this cushion material 9 may be structured by integrally forming and protruding a cushion material 13 having the effect of expansion and contract of the hollow ring with the inner lid 4 as shown in FIG. 3 for example. Further, any cushion material may be used so far as it has a spring effect.

Since the container according to this invention has, as mentioned above, the cushion material between the inner and the outer lids, this cushion material always presses down said inner lid to the bottle capsule, whereby said bottle capsule can be sealed. The conventional such sort of container has such defect that it provides for a non-cylindrical container such as ellipse, square type, etc. shown in FIG. 5 and the lid at the end of tightening availing the packing effect but it reduces its effect with the lapse of time, thereby causing the leakage of the contents because of the weak contact pressure between the bottle capsule of the container and the packing in spite of being possible to adjust the position of the container and the lid at the end of tightening. On the other hand, in case of this invention, the sealing plate of the inner lid always contacts with the bottle capsule with the constant contact pressure owing to the effect of the hinged structure even at the end of tightening with the aid of cushion material. Therefore, there is no anxiety of content leakage, and further there exists such characteristic to prevent the returning of the stopper because the torque becomes stronger by its contact pressure.

Further, in this invention the sealing plate of the inner lid having hinged structure expands at the hinged portion when the inner lid is screwed with the bottle capsule, and the circumferentiall wall of the inner lid falls down, whereby the cutaway groove of said inner lid catches the protuberance of the bottle capsule and the cushion material is compressed by the expansion stress in the hinged portion, thereby performing the closing of the inner lid completely. Since the hinged portion provides restoring force, it soon return to the original state when the lid is opened even if it is compressed to transform by closing the lid, having a durability to endure the repeating action sufficiently.

The container in accordance with this invention as described above, enables to close the lid completely absorbing the size variance of the inner lid and the bottle by the action of cushion material, thereby controlling the screwing of the lid properly. Accordingly, the container of this invention has the characteristic in enabling the attainment of the object completely tightening said lid strongly even if said lid to adjust the position has any particular shape and some size variance.

I claim:

1. A cap for closing a bottle shaped container comprising:

an inner lid (4) having a ring groove (6);

an outer lid (10) encompassing the inner lid and having a lateral rib (11) received in the ring groove;

said inner lid comprising a sealing plate (7) forming the top thereof and having a central portion connected to a side peripheral portion by a flexible hinged structure (8) so that the central portion is movable with respect to the peripheral portion; and cushion material (9, 13) disposed between the central portion of the inner lid and the outer lid for urging the central portion into contact with the container.

2. A cap according to claim 1, wherein the container has a shoulder portion that includes a protuberance (3) and the inner lid has a lower portion of an inner wall thereof formed with a groove (12) engageable with the protuberance to limit rotation of the cap with respect to the container.

3. A cap according to claim 1 or 2, wherein the cushion material is attached to the central portion of the sealing plate.

4. A cap according to claim 1 or 2, wherein the cushion material is integrally formed with the sealing plate.

* * * * *